US008766907B2

(12) United States Patent
Nishimoto

(10) Patent No.: US 8,766,907 B2
(45) Date of Patent: Jul. 1, 2014

(54) DRIVE CONTROL METHOD OF SUPPLYING IMAGE DATA FOR DISPLAYING DIVIDED DRIVE REGIONS OF A DISPLAY PANEL, DRIVE CONTROL DEVICE AND DISPLAY DEVICE FOR SUPPLYING IMAGE DATA FOR DISPLAYING DIVIDED DRIVE REGIONS OF A DISPLAY PANEL

(75) Inventor: Hirotaka Nishimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 102 days.

(21) Appl. No.: 13/387,133

(22) PCT Filed: Jul. 28, 2010

(86) PCT No.: PCT/JP2010/062665
§ 371 (c)(1),
(2), (4) Date: Jan. 26, 2012

(87) PCT Pub. No.: WO2011/013690
PCT Pub. Date: Feb. 3, 2011

(65) Prior Publication Data

US 2012/0120048 A1 May 17, 2012

(30) Foreign Application Priority Data

Jul. 31, 2009 (JP) ..... 2009-179196

(51) Int. Cl.
*G09G 3/36* (2006.01)

(52) U.S. Cl.
USPC ..... 345/103

(58) Field of Classification Search
CPC ... G09G 3/20; G09G 3/3666; G09G 2370/08; G09G 3/36
USPC ..... 345/103, 204, 211, 212
See application file for complete search history.

(56) References Cited

U.S. PATENT DOCUMENTS

| | | | | |
|---|---|---|---|---|
| 4,816,816 | A * | 3/1989 | Usui | 345/103 |
| 5,534,892 | A * | 7/1996 | Tagawa | 345/173 |
| 6,320,567 | B1 * | 11/2001 | Hirakata et al. | 345/100 |
| 7,119,808 | B2 * | 10/2006 | Gonzalez et al. | 345/502 |
| 2006/0017663 | A1 * | 1/2006 | Yamamoto et al. | 345/75.2 |

FOREIGN PATENT DOCUMENTS

| | | | |
|---|---|---|---|
| JP | 61205994 | A | 9/1986 |
| JP | 2009115936 | A | 5/2009 |

OTHER PUBLICATIONS

International Search Report dated Aug. 24, 2010.

* cited by examiner

*Primary Examiner* — Pegeman Karimi
(74) *Attorney, Agent, or Firm* — Harness, Dickey & Pierce, P.L.C.

(57) ABSTRACT

A drive control method for a display panel configured to constantly provide a good display quality with ensuring that EMI countermeasures are properly carried out is accomplished. Image data used to display a plurality of drive regions of a display panel obtained by dividing the display panel is supplied to data drivers of the plurality of drive regions based on transmission clock signals respectively having different transmission clock frequencies suitable for the plurality of divided drive regions, a common drive-start control signal used for all of the plurality of drive regions is generated based on a reference clock signal having a clock frequency different from any of the transmission clock frequencies, and drive signals start to be output from the data drivers of the plurality of drive regions to display elements corresponding to the respective data drivers at a same timing based on the supplied drive-start control signal.

9 Claims, 5 Drawing Sheets

DRIVE CONTROL METHOD OF SUPPLYING IMAGE DATA FOR DISPLAYING DIVIDED DRIVE REGIONS OF A DISPLAY PANEL, DRIVE CONTROL DEVICE AND DISPLAY DEVICE FOR SUPPLYING IMAGE DATA FOR DISPLAYING DIVIDED DRIVE REGIONS OF A DISPLAY PANEL

TECHNICAL FIELD

The present invention relates to a drive control method, a drive controller, and a display device, more particularly to a drive control method and a drive controller configured to drive pixels of a display panel arrayed in a matrix, and a display device provided with such a drive controller.

BACKGROUND ART

In an active matrix display device, an example of which is a liquid crystal display device, image data written in pixels of a display panel to display images is generated by a drive controller and then temporarily stored in source drivers provided in the display panel. Then, drive signals generated by the image data are supplied to the respective pixels (active elements) based on predetermined control signals.

The display devices available these days are larger in size and achieving higher definitions. Along with the ongoing advancement, increasingly faster transmission speeds (transmission clock frequency) are demanded to supply image data. Conventionally, electronic devices generate unwanted radiation such as electromagnetic wave and/or electric wave during their operations, which are typically called electromagnetic interference (EMI). The electromagnetic and electric waves thus generated by electronic devices adversely affect other circuits, therefore, it is crucial to find solutions for the problems caused by EMI. However, EMI countermeasures are more difficult to fulfill in display devices as the transmission clock frequencies are faster. An invention was disclosed as an effective EMI countermeasure in display devices in larger sizes with higher definitions. The invention divides a display panel into a plurality of drive regions without lowering the transmission clock frequency (see the Patent Document 1). According to the invention, the display panel is divided into two regions, and the divided drive regions are respectively provided with different transmission clock frequencies. This technique succeeds in facilitating upsizing, higher definitions, and EMI countermeasures in display devices.

Patent Document 1 Japanese Unexamined Patent Publication No. 2009-115936

Problem to be Solved by the Invention

Admittedly, the invention disclosed in the Patent Document 1 provides an advantageous technique for favorably effecting upsizing, higher definitions, and EMI countermeasures in display devices. However, the invention has a problem; because the drive regions respectively have different transmission clock frequencies for transmitting image data, an length of time for drive signals to be supplied to pixel active elements differs from one drive region to the other. Particularly in a liquid crystal display device, for example, the problem led to the concern that a length of time for liquid crystal to be electrically charged also differs from one drive region to the other, resulting in different display qualities in the respective drive regions (see FIG. 5).

DISCLOSURE OF THE PRESENT INVENTION

To solve the conventional technical problems, the present invention provides a drive control method, a drive controller, and a display device configured to constantly provide a good display quality while ensuring that EMI countermeasures are properly carried out.

Means for Solving the Problem

To solve the conventional technical problems, the present invention provides a drive control method of supplying image data for displaying a plurality of divided drive regions of a display panel to data drivers corresponding to each of the drive regions based on transmission clock signals respectively having different transmission clock frequencies suitable for each of the divided drive regions. The method includes generating a reference clock signal having a clock frequency different from the transmission clock frequencies, generating a common drive-start control signal that is commonly used for all of the drive regions based on the reference clock signal, supplying the drive-start control signal to each of the data drivers of the drive regions, and starting outputting of drive signals from the data drivers of the drive regions to display elements corresponding to the respective data drivers at a same timing in response to the supplied drive-start control signal.

The present invention further provides a drive control device configured to supply image data for displaying a plurality of divided drive regions of a display panel to data drivers corresponding to each of the drive regions based on transmission clock signals respectively having different transmission clock frequencies suitable for the divided drive regions. The drive control device includes a clock signal generator circuit configured to generate a reference clock signal having a clock frequency different from the transmission clock frequencies, and a drive-start control circuit configured to generate a common drive-start control signal that is commonly used for all of the drive regions based on the reference clock signal and supply the generated drive-start control signal to data drivers of the drive regions, and make each of the data drivers of the drive regions to start outputting of drive signals to corresponding display elements at a same timing in response to the supplied drive-start control signal.

The present invention further provides a display device, including a display panel divided into a plurality of drive regions, a plurality of display elements arranged in a matrix in each of the drive regions, and data drivers each provided for each of the drive regions, the data drivers receiving image data for displaying each of the drive regions based on transmission clock signals respectively having different transmission clock frequencies suitable for each of the divided drive regions. The display device further includes a clock signal generator circuit configured to generate a reference clock signal having a clock frequency different from the transmission clock frequencies, and a drive-start control circuit configured to generate a common drive-start control signal that is commonly used for all of the drive regions based on the reference clock signal and supply the generated drive-start control signal to data drivers of the drive regions, the drive-start control circuit further being configured to make each of the data drivers of the drive regions to start outputting of drive signals to corresponding display elements at a same timing in response to the supplied drive-start control signal.

BEST MODE FOR CARRYING OUT THE INVENTION

Hereinafter, an embodiment of the present invention is described with reference to FIGS. 1 to 5. A display device according to the embodiment described below is a liquid crystal display (LCD) device provided with a liquid crystal panel. The display device, however, is not necessarily limited to the liquid crystal display device as far as any active matrix display device is used. Other examples of the display device are a PDP (plasma display panel) display device, and an organic EL (electro-luminescence) display device.

1. Circuit Configuration

Figure 1:
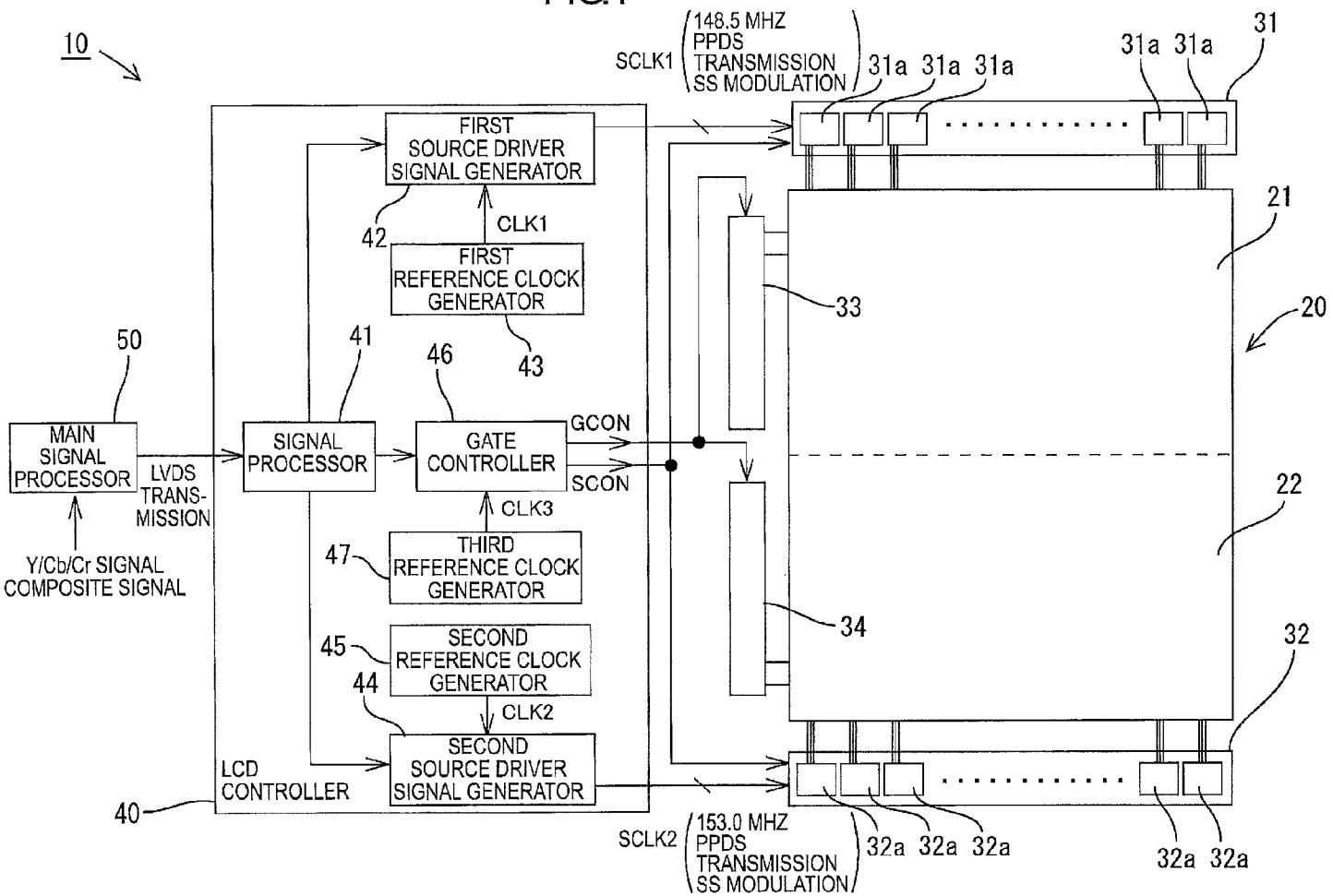
FIG. 1 is a block diagram schematically illustrating an LCD display device according to an embodiment of the present invention.
Figure 2:
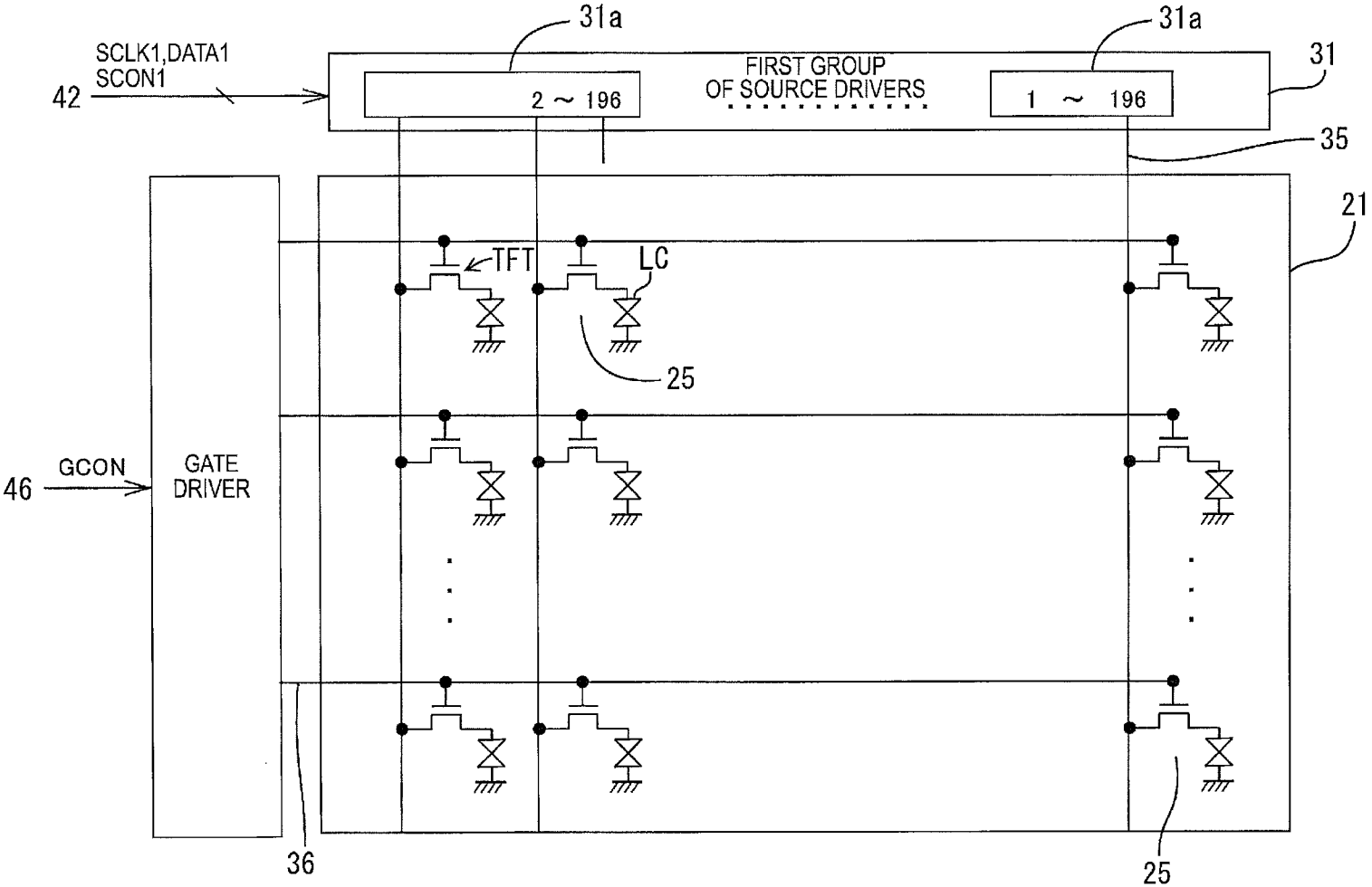
FIG. 2 is a schematic illustration of pixels arrayed in a matrix in a first drive region of the LCD display device.

FIG. 1 is a block diagram schematically illustrating an LCD display device (an example of "display device") 10 according to the present embodiment. FIG. 2 schematically illustrates pixels 25 arrayed in a matrix in a first drive region 21 described later. A second drive region 22 similarly configured is not illustrated in the drawing.

Main structural elements of the LCD display device 10 are an LCD panel 20, first and second groups of source drivers 31 and 32, an LCD controller (an example of "drive control device") 40, and a main signal processor 50. The first and second groups of source drivers 31 and 32 apply drive signals to the LCD panel 20. The LCD controller 40 outputs signals of various types used to generate the drive signals to the first and second groups of source drivers 31 and 32. The main signal processor 50 converts image data into data for the drive signals and outputs the converted data to the LCD controller 40.

An image signal processing flow is briefly described below. The image signals, such as composite signal and component video signal (Y/Cb/Cr), are input to the main signal processor 50 and subjected to predetermined conversion processes therein. The post-conversion signals are then transmitted to the LCD controller 40 according to a transmission technique, for example, LVDS (low-voltage differential signal) transmission. The image signals are converted into signals for source drivers in the LCD controller 40 and temporarily stored in the first and second groups of source drivers 31 and 32. Then, the image data is written in the pixels 25 of the LCD panel 20 at a predetermined timing at which scan signals (ON signals) are applied to gate lines 36 extending from gate drivers 33 (during a time period from t1 to t2 illustrated in FIG. 4).

Next, structural elements of the LCD display device 10 are described. As illustrated in FIG. 2, the LCD panel 20 includes a plurality of pixels 25, a plurality of source lines 35, and a plurality of gate lines 36. The plurality of pixels (an example of "display element") 25 is arrayed in a matrix. The pixels 25 each include TFT (thin film transistor) which is a switching element, and a liquid crystal cell LC gradation-controlled by the TFT to emit light at any intended brightness. As is known to the skilled in the art, the liquid crystal cell LC is not self-luminescent but changes an amount of transmitted light of back light depending on a voltage applied by way of the TFT (charging amount) to thereby change the brightness of each pixel.

Drive signals used to drive the TFTs of the pixels 25 at any intended voltage are applied to the source lines 35. Scan signals (gate driver output signals) used to choose which line should be scanned are applied to the gate lines 36. The pixels 25 vertically arrayed on the same column are connected to each of the source lines 35. The pixels 25 horizontally arrayed on the same row are connected to each of the gate lines 36.

For example, the LCD panel 20 is divided into two regions; an upper-half first drive region (upper screen) 21 and a lower-half second drive region (lower screen) 22. Therefore, the source lines 35 are vertically divided into upper and lower two groups of source lines and respectively connected to the first group of source drivers 31 and the second group of source drivers 32.

The first group of source drivers 31 is provided on the upper-half section of the LCD panel 20 as drivers which supply the drive signals to the pixels 25 of the first drive region 21. The second group of source drivers 32 is provided on the lower-half section of the LCD panel 20 as drivers which supply the drive signals to the pixels 25 of the second drive region 22. A first group of gate drivers 33 and a second group of gate drivers 34 which obtain scan signals to be applied to the gate lines 36 from a gate controller 46 and apply the obtained scan signals to the gate lines 36 are provided on the left side of the LCD panel 20 correspondingly with the first drive region 21 and the second drive region 22. The first and second groups of gate drivers 33 and 34 respectively include a plurality of gate drivers having a predetermined number of scan signal output terminals.

Source drivers (representing "data driver") 31*a* of the first group of source drivers 31 have a predetermined number of, for example, 192 drive signal output terminals. In the case where the LCD panel 20 has, for example, 1920×1080 pixels for full high vision, the first group of source drivers 31 includes 30 source drivers 31*a* correspondingly with 1920×3 (for RGB) source lines 35. Similarly, the second group of source drivers 32 includes 30 source drivers 32*a*.

The LCD controller 40 functioning as a drive controller of the LCD panel 20 includes a signal processing circuit 41, first and second source driver signal generators 42 and 44, a gate controller 46, and first to third reference clock generators 43, 45, and 47.

The signal processing circuit 41 generates data (image data) signals to be applied to the pixels 25 of the first drive region 21 and the second drive region 22 and outputs the generated data signals to the first and second source driver signal generators 42 and 44.

The first reference clock generator 43 generates a first reference clock signal CLK1 and outputs the generated first reference clock signal CLK1 to the first source driver signal generator 42. The first source driver signal generator 42 generates a first source clock signal SCLK1 having a predetermined frequency (representing "first transmission clock frequency") based on the first reference clock signal CLK1. The first source driver signal generator 42 transmits an image data signal DATA1 to the source drivers 31*a* of the first group of source drivers 31 in synchronization with the first source clock signal SCLK1.

According to the present embodiment, the first reference clock signal CLK1 and the first source clock signal SCLK1 have an equal frequency, meaning that the first reference clock signal CLK1 and the first source clock signal SCLK1 are regarded as the same signal. However, the first reference clock signal CLK1 and the first source clock signal SCLK1 do not necessarily have an equal frequency. For example, the frequency of the first reference clock signal CLK1 may be divided, and the first source clock signal SCLK1 may be generated based on the frequency-divided first reference clock signal CLK1.

Similarly to the first reference clock generator 43, the second reference clock generator 45 generates a second reference clock signal CLK2 and outputs the generated second reference clock signal CLK2 to the second source driver signal generator 44. The second source driver signal generator 44 generates a second source clock signal SCLK2 having a predetermined frequency (representing "second transmission clock frequency") based on the second reference clock signal CLK2. The second source driver signal generator 44 transmits an image data signal DATA2 to the source drivers 32*a* of the second group of source drivers 32 in synchronization with the second source clock signal SCLK2.

Similarly to the first source clock signal SCLK1, the second reference clock signal CLK2 and the second source clock signal SCLK2 have an equal frequency, meaning that the second reference clock signal CLK2 and the second source clock signal SCLK2 are regarded as the same signal. For example, the frequency of the second reference clock signal CLK2 may be divided, and the second source clock signal SCLK2 may be generated based on the frequency-divided second reference clock signal CLK2.

The frequency of the first source clock signal SCLK1 (first transmission clock frequency) is, for example, 148.5 MHz, and the frequency of the second source clock signal SCLK2 (second transmission clock frequency) is, for example, 153.0 MHz. Thus, the different clock frequencies are respectively used to transmit the image data to the first group of source drivers 31 of the first drive region 21 and to transmit the image data to the second group of source drivers 32 of the second drive region 22. When the different clock frequencies are thus used for transmission, unwanted radiation (EMI) generated in different transmission paths can be split in a frequency-axis direction. This lowers a peak value of the unwanted radiation.

Figure 3:
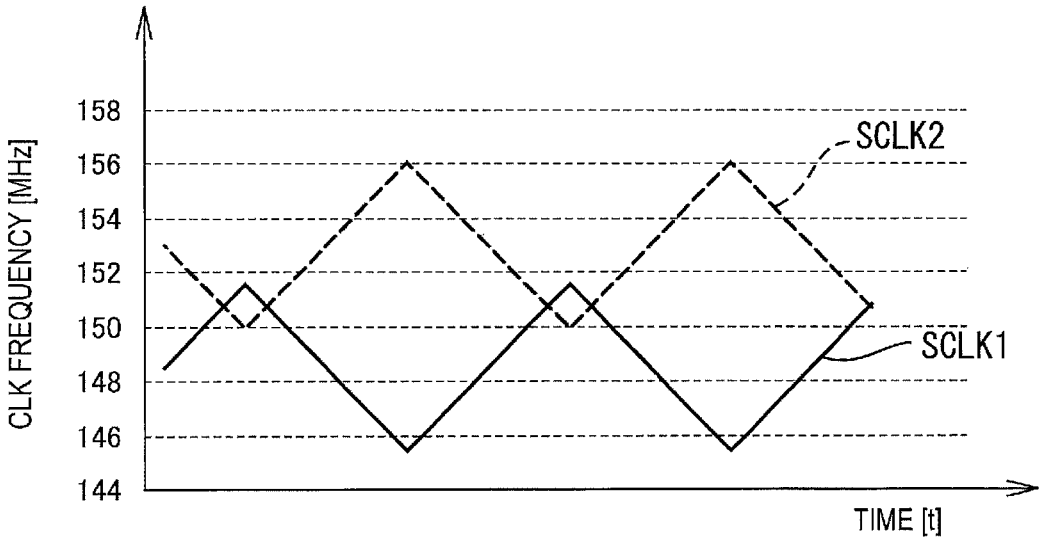
FIG. 3 is a diagram illustrating shifts of transmission clock frequencies in spread spectrum modulation.

A transmission method employed to transmit the first and second source clock signals (image data) SCLK1 and SCLK2 from the first and second source driver signal generators 42 and 44 to the first and second groups of source drivers 31 and 32 is, for example, a PPDS (point-to-point differential signaling: registered trademark) transmission method or a RSDS (reduced swing differential signaling: registered trademark) transmission method. The first and second source clock signals SCLK1 and SCLK2 are transmitted, for example, according to the PPDS, and subjected to SS (spread spectrum) modulation to reduce any unwanted radiation as illustrated in FIG. 3. As a result of the SS modulation, the first source clock signal SCLK1 has a frequency shift in the range of, for example, 145.5 to 151.5 MHz, and the second source clock signal SCLK2 has a frequency shift in the range of, for example, 150.0 to 156.0 MHz as illustrated in FIG. 3.

The third reference clock generator (representing "clock signal generator circuit" according to the present invention) 47 generates a third reference clock signal (representing "reference clock signal" according to the present invention) CLK3 having a clock frequency different from the clock frequencies of the first and second source clock signals SCLK1 and SCLK2. The third reference clock signal CLK3 is, for example, input to the gate controller 46.

The gate controller (an example of "drive-start control circuit") 46 generates a common source driver control signal (representing "drive-start control signal") SCON (SCON1, SCON2) that can be used for the first and second drive regions (21, 22) both based on the third reference clock signal CLK3. The gate controller 46 supplies the source driver control signal SCON to the source drivers (31*a*, 32*a*) of the first and second drive regions (21, 22) to start to output the drive signals from the source drivers (31*a*, 32*a*) to the pixels (display elements) 25 corresponding to the source drivers at a same timing in response to the source driver control signal SCON.

The gate controller 46 further generates a gate driver control signal GCON based on the third reference clock signal CLK3. The gate driver control signal GCON is comparable to a horizontal synchronous signal for displaying an image on the LCD display panel 20. The gate lines 36 are each scanned in accordance with the gate driver control signal GCON.

The gate driver control signal GCON is input to the foremost gate drivers of the first and second groups of gate drivers 33 and 34. The input gate driver control signal GCON is then shifted in and between the gate drivers to select the gate lines 36 one after another.

The first and second source driver control signals (SCON1, SCON2) are signals which respectively render the outputs of the source drivers 31*a* and 32*a* active or inactive. In accordance with the first and second source driver control signals SCON1 and SCON2, the drive signals start or cease to be output from the source drivers 31*a* and 32*a* to the liquid crystal cells (an example of "display element") LC corresponding to the respective source drivers. Based on the first and second source driver control signals SCON1 and SCON2 thus characterized, the outputs of the source drivers 31*a* and 32*a* are applied to sources of the TFTs of the pixels 25 corresponding to the respective source drivers in a given length of time to electrically charge the relevant liquid crystal cells LC.

As described earlier, the first source driver control signal SCON1 and the second source driver control signal SCON2 according to the present embodiment are regarded as the same signal. In the description given below, therefore, the first source driver control signal SCON1 and the second source driver control signal SCON2 are collectively called "source driver control signal SCON".

According to the present embodiment described so far, the common source driver control signal SCON is generated based on the third reference clock signal CLK3 having a frequency different from the first and second source clock frequencies SCLK1 and SCLK2, and the outputs of the first and second groups of source drivers 31 and 32 are controlled based on the common (same) source driver control signal (drive-start control signal) SCON.

2. Description of Operation

Figure 4:
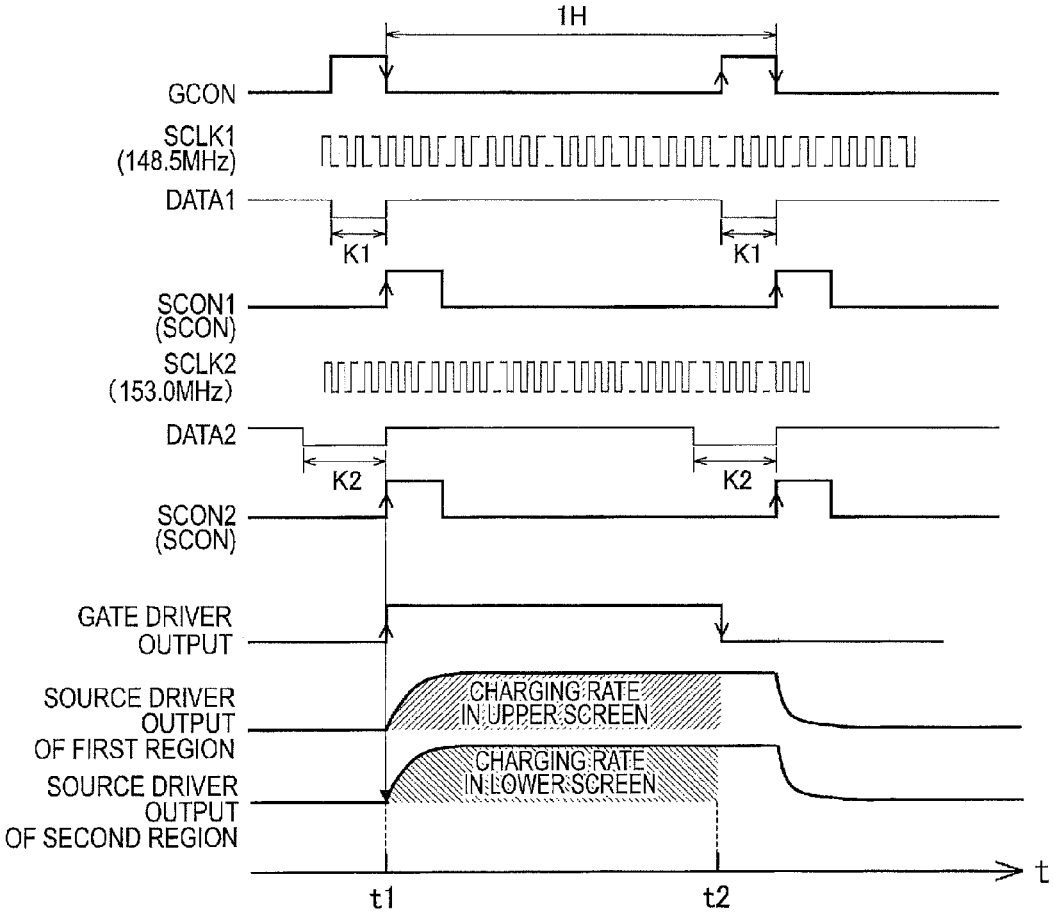
FIG. 4 is a time chart illustrating signal transitions according to the embodiment.
Figure 5:
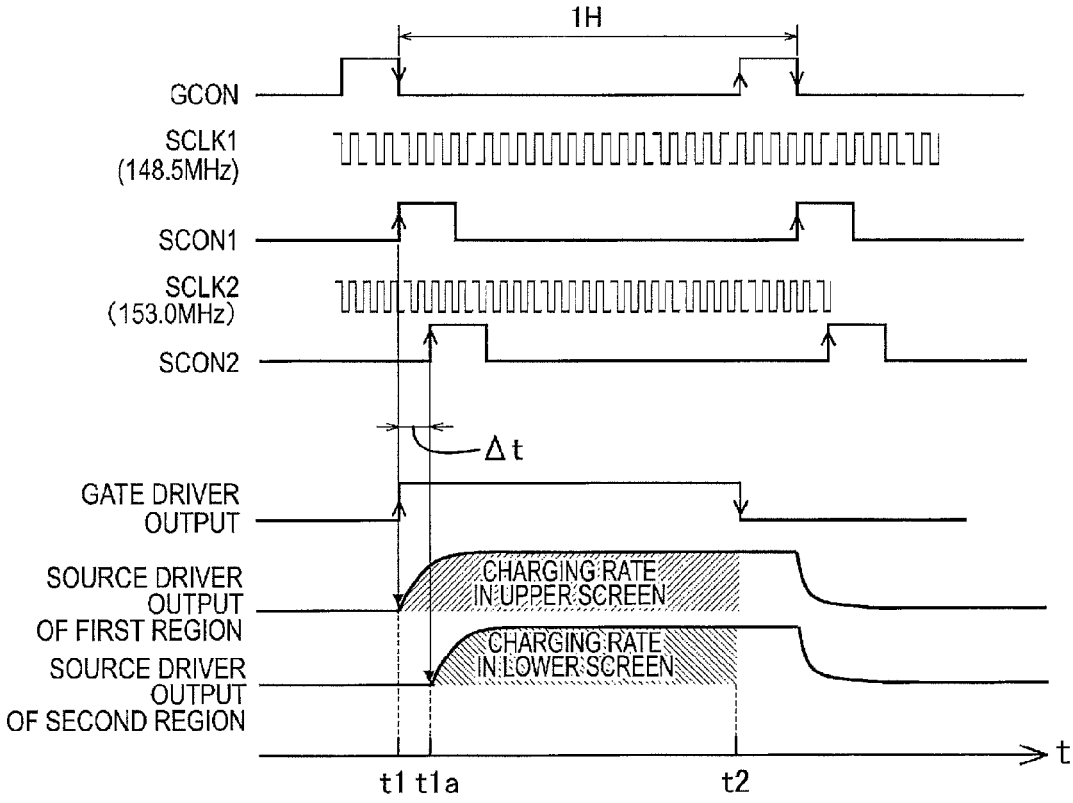
FIG. 5 is a time chart illustrating signal transitions according to a prior art.

A characteristic operation associated with a drive control of the LCD panel 20 by the LCD controller 40 according to the present embodiment is hereinafter described with reference to FIGS. 4 and 5. FIG. 4 is a time chart of signals associated with the drive control of the LCD panel 20 according to the present embodiment. FIG. 5 is a time chart of signals associated with the drive control of the LCD panel 20 according to a prior art.

At a time point t1 illustrated in FIG. 4, the gate driver control signal GCON for a predefined gate line 36(*n*), for example, falls, and the common source driver control signal SCON (SCON1, SCON2) rises in response to the fall of the gate driver control signal GCON. In response to the fall of the gate driver control signal GCON, outputs of the gate drivers corresponding to the predefined gate line 36 also rise in the first and second drive regions 21 and 22.

In response to the rise of the common source driver control signal SCON, the source driver outputs are respectively output to the source lines 35 from the output terminals (1 to 196) of the first source drivers 31*a* of the first drive region 21 and the second source drivers 32*a* of the second drive region 22. In response to the rise of the gate driver outputs, gates G of the TFTs connected to the predefined gate line 36 in the first and second drive regions (21, 22) are rendered active, and the liquid crystal cells LC of the TFTs connected to the predefined gate line 36 in the first and second drive regions 21 and 22 start to be electrically charged concurrently at the time point t1 (representing "same timing").

The timing for the common source driver control signal SCON to rise, which is the time point t1 when the liquid crystal cells LC start to be electrically charged, is preferably included in a transmit-forbidden period K1 of a first image data DATA1 transmitted by the first source clock signal SCON1 which is one of transmit-forbidden periods K1 and K2 in the respective regions.

More specifically, the LCD controller 40 preferably supplies the output start signal to the data drivers of the respective drive regions during the transmit-forbidden period of the image data transmitted by the transmission clock signal having the lowest transmission clock frequency among the different transmission clock frequencies to thereby start to output the drive signals to the display elements. Accordingly, the drive signals can surely start to be output to the pixels (display elements) 25 of the drive regions 21 and 22 almost concurrently at the time point t1 although the transmission clock signals for the drive regions 21 and 22 have different frequencies.

At a time point t2 illustrated in FIG. 4, when the gate driver control signal GCON (n+1) for a gate line 36 (n+1) next to the predefined gate line 36(*n*) rises, outputs of the gate drivers corresponding to the predefined gate line 36(*n*) fall in the first and second drive regions 21 and 22 in response to the rise of the gate driver control signal GCON (n+1) for the next gate line 36. In response to the fall of the gate driver outputs, gates G of the TFTs connected to the predefined gate line 36(*n*) in the first and second drive regions (21, 22) are rendered inactive, and the liquid crystal cells LC of the TFTs connected to the predefined gate line 36(*n*) in the first and second drive regions 21 and 22 all cease to be electrically charged at the time point t2.

Similarly, the liquid crystal cells LC of the pixels 25 connected to the gate line 36 (n+1) start to be electrically charged when the gate driver control signal GCON (n+1) falls at a time point t3.

According to the present embodiment, the common source driver control signal SCON is generated based on the third reference clock signal CLK3 having a frequency different from those of the first and second source clock signals SCLK1 and SCLK2, and outputs of the first and second groups of source drivers 31 and 32 are controlled based on the generated common source driver control signal SCON. Thus configured, the liquid crystal cells LC of the pixels 25 can be electrically charged in substantially an equal length of time (from time point t1 to time point t2) in the first and second drive regions 21 and 22.

In the prior art illustrated in FIG. 5 wherein the first source driver control signal SCON1 is generated based on the first source clock signal SCLK1 and the second source driver control signal SCON2 is generated based on the second source clock signal SCLK2, there is a difference between the lengths of time necessary for electrically charging the liquid crystal cells LC respectively in the first and second drive regions 21 and 22. In the case where the liquid crystal cells LC in the first drive region 21 start to be electrically charged at a time point t1 illustrated in FIG. 5, a time point when the liquid crystal cells LC in the second drive region 22 start to be electrically charged is delayed by a time difference Δt to a time point t1*a* because of a frequency difference between the first source clock signal SCLK1 and the second source clock signal SCLK2.

When, for example, the frequency of the first source clock signal SCLK1 is set to 148.5 MHz and the frequency of the second source clock signal SCLK2 is set to 150.0 MHz for 1H (horizontal period) of 6.8 μsec, the largest value of the time difference Δt is approximately 200 nsec.

Conventionally, there is a frequency shift by approximately ±2□ when the first and second source clock signals SCLK1 and SCLK2 are SS-modulated. Therefore, the largest value of the time difference Δt is likely to increase to values larger than 200 nsec. The present embodiment, however, can reduce the time difference Δt to almost 0 nsec although it conventionally tends to increase.

3. Effect of the Embodiment

As described so far, the present embodiment uses the clock signals SCLK1 and SCLK2 having different frequencies to transmit the image data in the first and second drive regions 21 and 22. Moreover, the present embodiment generates the source driver control signals SCON1 and SCON2 based on the third reference clock signal CLK3 having a frequency different from those of the transmission clock signals SCLK1 and SCLK2, thereby providing the common source driver control signal SCON. The technical feature of the present embodiment can substantially equalize the lengths of time for the liquid crystal cells LC to be electrically charged in the first and second drive regions 21 and 22. The present embodiment thus technically advantageous can constantly provide a good display quality while ensuring that the EMI countermeasures in driving the LCD panel are properly carried out.

The common source driver control signal (drive-start control signal) SCON is generated based on the clock signal CLK3 used to generate the gate driver control signal (horizontal synchronous signal) GCON. Therefore, the source driver control signal SCON can be generated in association with the generation of the gate driver control signal (horizontal synchronous signal) GCON. Thus, the source driver control signal SCON can be readily and suitably generated.

Another Embodiment

The present invention is not necessarily limited to the embodiment described so far with reference to the accompanied drawings. The technical scope of the present invention further includes the following embodiment.

(1) To divide the LCD panel 20 into a plurality of drive regions, the embodiment divides the LCD panel 20 into upper and lower two regions, however, the present invention is not necessarily limited thereto. The LCD panel 20 may be arbitrarily divided into more than one region. For example, the present invention is applicable to the LCD panel 20 divided into upper and lower four regions.

(2) According to the embodiment, the common source driver control signal (drive-start control signal) SCON is generated based on the clock signal CLK3 used to generate the gate driver control signal (horizontal synchronous signal) GCON. However, the present invention is not necessarily limited thereto as far as the common source driver control signal (drive-start control signal) SCON is generated based on a reference clock signal having a clock frequency different from any of the transmission clock frequencies. When such a reference clock signal is used, the reference clock signal may be directly used, or the reference clock signal may be frequency-divided and then used to generate the drive-start control signal.

(3) The embodiment uses the gate controller 43 as the drive-start control circuit according to the present invention, however, the present invention is not necessarily limited thereto. Any other circuit configuration in the LCD controller 40 may constitute the drive-start control circuit.

The invention claimed is:

1. A drive control method comprising:

generating a first transmission clock signal having a first transmission clock frequency;

supplying the first transmission clock signal to a first data driver that is configured to output drive signals to display elements included in a first one of divided drive regions in a display panel;

generating a second transmission clock signal having a second transmission clock frequency that is different from the first transmission clock frequency;

supplying the second transmission clock signal to a second data driver that is configured to output drive signals to display elements included in a second one of the divided drive regions in the display panel;

generating a reference clock signal having a clock frequency different from the first and second transmission clock frequencies;

generating a common drive-start control signal based on the reference clock signal;

supplying the generated common drive-start control signal to the first and second data drivers; and controlling each of the first and second data drivers to start outputting the drive signals to the display elements included in the first and second divided drive regions at a same timing in response to the supply of the common drive-start control signal.

2. The drive control method according to claim 1, wherein the generating step includes generating the drive-start control signal based on a clock signal that is used as the reference clock signal to generate a horizontal synchronous signal of the display panel.

3. The method of claim 1, further comprising:

initiating and terminating the output of the drive signals to the display elements in the first and second divided drive regions based on the common drive-start control signal.

4. A drive control device comprising:

a first transmission clock signal generator configured to generate a first transmission clock signal having a first transmission clock frequency and supply the first transmission clock signal to a first data driver that is configured to output drive signals to display elements included in a first one of divided drive regions in a display panel;

a second transmission clock signal generator configured to generate a second transmission clock signal having a second transmission clock frequency that is different from the first transmission clock frequency and supply the second transmission clock signal to a second data driver that is configured to output drive signals to display elements included in a second one of the divided drive regions in the display panel;

a reference clock signal generator circuit configured to generate a reference clock signal having a clock frequency different from the first and second transmission clock frequencies; and a drive-start control circuit configured to, generate a common drive-start control signal based on the reference clock signal;

supply the generated common drive-start control signal to the first and second data drivers; and control each of the first and second data drivers to start outputting the drive signals to the display elements included in the first and second divided drive regions at a same timing in response to the supply of the common drive-start control signal.

5. The drive control device according to claim 4, wherein the drive-start control circuit is configured to generate the drive-start control signal based on a clock signal that is used as the reference clock signal to generate a horizontal synchronous signal of the display panel.

6. The drive control device of claim 4, wherein the first and second data drivers are configured to initiate and terminate the output of the drive signals to the first and second divided drive regions, respectively, based on the common drive-start control signal.

7. A display device, comprising:

a display panel divided into a plurality of drive regions including a first drive region and a second drive region;

a plurality of display elements arranged in a matrix in each of the first and second drive regions;

a first transmission clock signal generator configured to generate a first transmission clock signal having a first transmission clock frequency;

a first data driver configured to receive image data for displaying the first drive region based on the first transmission clock signal;

a second transmission clock signal generator configured to generate a second transmission clock signal having a second transmission clock frequency that is different from the first transmission clock signal;

a second data driver configured to receive image data for displaying the second drive region based on the second transmission clock signal;

a reference clock signal generator configured to generate a reference clock signal having a clock frequency different from the first and second transmission clock frequencies; and a drive-start control circuit configured to, generate a common drive-start control signal based on the reference clock signal, supply the generated common drive-start control signal to the first and second data drivers, and control each of the first and second data drivers to start outputting drive signals to display elements included in the first and second divided drive regions at a same timing in response to the supply of the common drive-start control signal.

8. The display device according to claim 7, wherein the drive-start control circuit is configured to generate the drive-start control signal based on a clock signal that is used as the reference clock signal to generate a horizontal synchronous signal of the display panel.

9. The display device of claim 7, wherein the first and second data drivers are configured to initiate and terminate the output of the drive signals to the first and second divided drive regions, respectively, based on the common drive-start control signal.

* * * * *